United States Patent [19]

Grinwald et al.

[11] Patent Number: 4,783,923

[45] Date of Patent: Nov. 15, 1988

[54] ACTUATOR FOR SLIDING PANEL SIGNS

[75] Inventors: Harold M. Grinwald, Big Bend; Charles E. Trame, Mequon, both of Wis.

[73] Assignee: Everbrite Electric Signs, Inc., Greenfield, Wis.

[21] Appl. No.: 101,490

[22] Filed: Sep. 28, 1987

[51] Int. Cl.[4] ..... G09F 7/00

[52] U.S. Cl. ..... 40/488; 40/476; 40/491

[58] Field of Search ..... 40/488, 375, 378, 476, 40/491

[56] References Cited

U.S. PATENT DOCUMENTS

| | | | |
|---|---|---|---|
| 1,609,485 | 12/1926 | Maier | 40/488 |
| 2,117,187 | 5/1938 | MacLaren | 40/488 |
| 2,833,066 | 5/1958 | Morrissey | 40/488 |
| 3,013,352 | 12/1961 | Delfini et al. | 40/491 |
| 3,080,668 | 3/1963 | Reali | 40/491 |
| 3,421,240 | 1/1969 | Bardi | 40/491 |
| 3,430,371 | 3/1969 | Phillips | 40/488 |
| 4,164,086 | 8/1979 | Azcaráte de Morgan et al. | 40/491 |
| 4,489,514 | 12/1984 | Honse | 40/476 |

FOREIGN PATENT DOCUMENTS

| | | | |
|---|---|---|---|
| 807891 | 3/1969 | Canada | 40/488 |

*Primary Examiner*—Robert P. Swiatek
*Assistant Examiner*—Cary E. Stone
*Attorney, Agent, or Firm*—Fuller, Puerner & Hohenfeldt

[57] ABSTRACT

A sign has slat panels mounted for sliding laterally on one side of a base plate and bars having cam followers mounted on the other side. Each bar has a pin, some of which project through slats in the bars and all of which project through slots in the base plate to terminate in a hole in the panels, respectively for driving the panels laterally in response to sequential lateral shifting of the bars. A first driven gear has axially extending cam pins of increasingly greater lengths to engage successive followers and shift the bars and panels to present a series of pictures. A second commonly driven gear has one cam pin which orbits in the opposite direction for periodically engaging all followers simultaneously and driving said bars back to initial position to start a new display cycle.

7 Claims, 3 Drawing Sheets

ACTUATOR FOR SLIDING PANEL SIGNS

BACKGROUND OF THE INVENTION

The invention described herein pertains to signs of the type in which there are several panels having slats that are interleaved and relatively slidable individually so as to accomplish display of several images or pictures sequentially. In particular, the invention resides in an improved actuator for such signs.

U.S. Pat. Nos. 3,430,371; 3,421,240 and 4,489,514 disclose multiple interleaved sliding panel signs in which various kinds of actuator mechanisms are used. The actuator disclosed herein is for sliding the panels in signs of the general type described in the cited patents. Usually the panels in this type of sign are comprised of a horizontal strip to which vertical slats having portions of a picture printed on them are attached. The actuator mechanism typically drives one slat panel at a time relative to the other slat panels for displaying the pictures in sequence. Some of the disadvantages of known panel actuators is that they contain a large number of parts such as links and cams which form a complex mechanism that is often noisy, has increased likelihood of premature failure and is costly to manufacture and maintain.

SUMMARY OF THE INVENTION

The main objective of the invention disclosed herein is to provide an actuator for slat signs that contains a minimum number of parts and is simple, reliable, relatively inexpensive to manufacture and operates quietly.

Briefly stated, the embodiment of the new sign actuator described herein comprises a stationary base in the form of a plate composed of a rigid material disposed in a vertical plane. Several stud bolts are arranged along a horizontal line extending from both sides of the base plate. Several slidable bars, preferably of plastic, are interfaced with each other and are provided with lengthwise extending slots by which the bars are all hung on the studs extending from the rear sides of the base plate. The slots enable the bars to be slid lengthwise or laterally relative to each other in sequence.

The sign panels are hung on the studs extending from the front of the chassis plate. Each panel is comprised of a horizontal strip having slats extending in parallelism from it. If the strips are horizontal, the slats will be oriented vertically. The slats of each panel, respectively, employ the known technique of having parts of each picture or image on them and the slats of each panel are interleaved. Drive pins extend from each slidable bar behind the base plate through elongated slots in the plate and into holes in the respective panel strips so when the bars are slid in sequence the panels are driven in sequence in a corresponding direction to thereby present a succession of different pictures to anyone looking at the slats.

The actuator includes an electric motor with a speed reducer mounted behind the base plate. A first gear has teeth meshed with the teeth of a second similar gear which rotates in a direction opposite of the first gear. A pinion on a shaft extending from the speed reducer drives one of the gears. Cam pins arranged in a circle extend from one side of the first gear disk. The cam pins vary in length in uniform steps from the shortest to the longest. A single cam pin extends axially from the second gear. The bars behind the base plate have follower lobes extending from them at right angles to their direction of travel. When the first gear is driven rotationally, the shortest of the orbiting cam pins to the longest will strike the follower lobes on the bars in succession and shift them through an equal distance. Hence, the drive pins extending from the bars shift the panels in corresponding succession to display the sequence of pictures. When all bars and panels are shifted to substantially the same limit, the cam pin on the second gear, which is rotating oppositely from the first gear, reaches the proper rotational angle for striking all of the follower lobes at one time to thereby return all of the bars and panels back to starting position for repeating the display cycle.

A more detailed description of a preferred embodiment of the invention will now be set forth in reference to the drawings.

DESCRIPTION OF A PREFERRED EMBODIMENT

Figure 1:
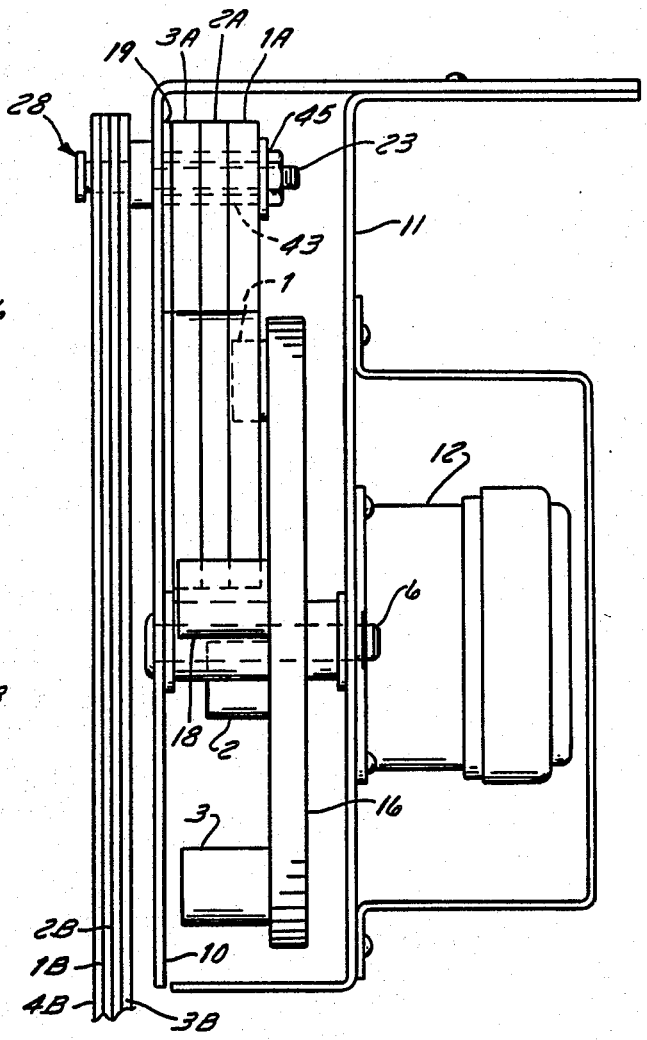
FIG. 1 is a side elevational view of the new actuator in conjunction with an interleaved slat sign that is actuated by the actuator, the sign having parts broken away.

Referring to FIG. 1, the sign comprises a chassis or frame including a front base plate 10 disposed in a vertical plane and a rear vertical motor mounting plate 11. A drive motor and integral speed reducer 12 is mounted to plate 11. As shown most clearly in FIG. 3, there is a pinion 13 fastened to the shaft 14 of motor and speed reducer 12. The teeth of pinion 13 are meshed with the teeth of a gear 15. The teeth of gear 15 are meshed with the teeth of a panel return gear 16. Thus, in this embodiment, gears 15 and 16 rotate at the same speed in opposite directions. In this particular design in which there are three slidable image panels such as the one depicted in FIG. 2 and on a foremost panel that can be stationary, there are three cam pins 1, 2 and 3 extending axially from gear 15 and radially displaced from the hub 17 of gear 15. Cam pin 1 is the shortest. Cam pin 2 is longer than pin 1 by a specific amount and cam pin 3 is longer than pin 2 by the same amount. Gear 15 with its cams acts as a panel shifting drive gear and gear 16 acts as a panel returning gear. Gear 16 has only one cam pin 18 extending axially from it. Pin 18 on return gear 16 extends axially by the same amount as does the longest pin on gear 15 which is pin 3 in this case. Gears 15 and 16 rotate shafts 5 and 6, respectively.

Figures 2, 3:
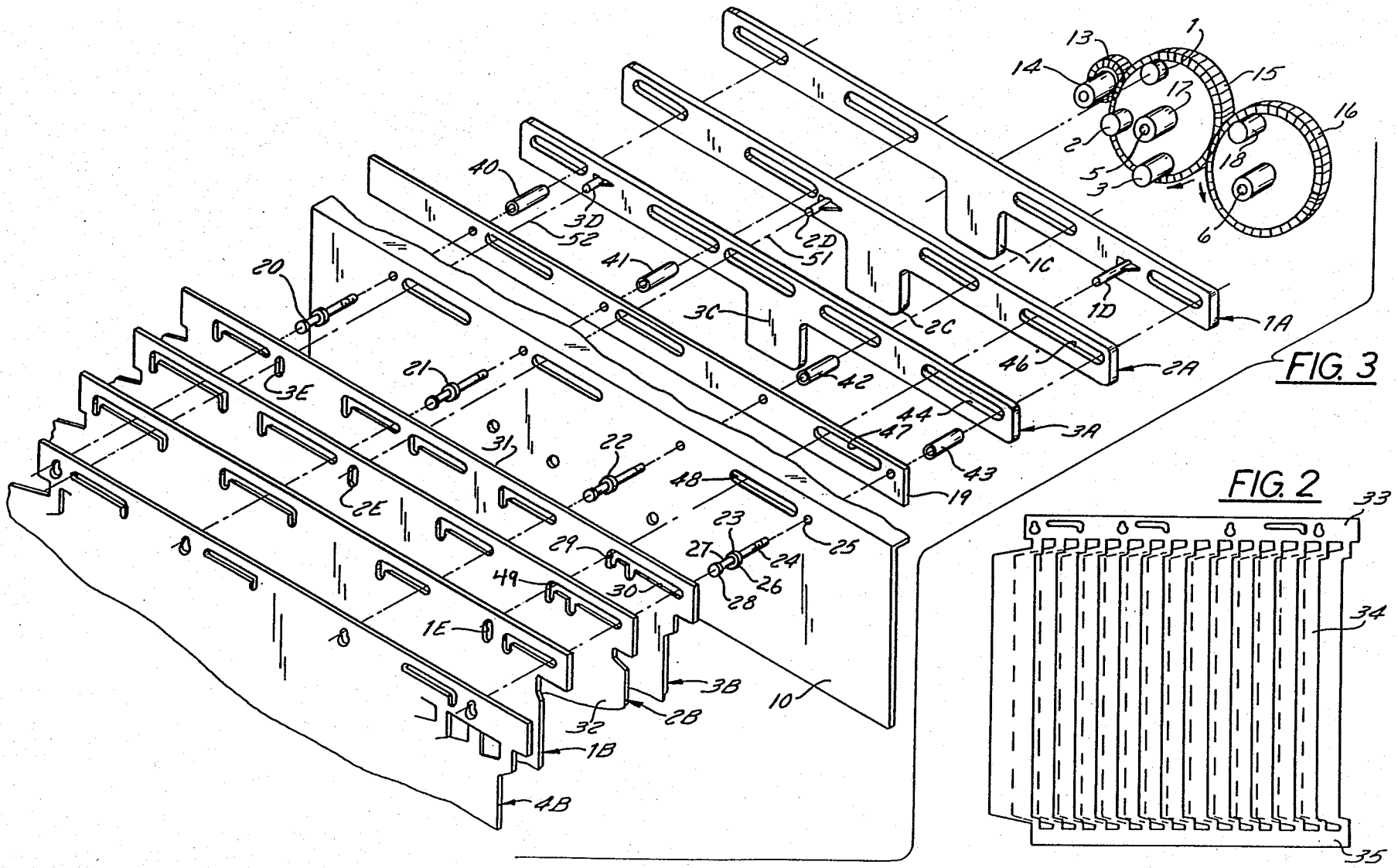
FIG. 2 is a front elevational view of a typical sign panel having vertical slats connected together at its top and bottom with upper and lower cross strips.
FIG. 3 is an exploded view of an actuator in conjunction with a multiple panel sign where the drive gears and cams are shown but the motor for turning them is omitted.
Figure 5:
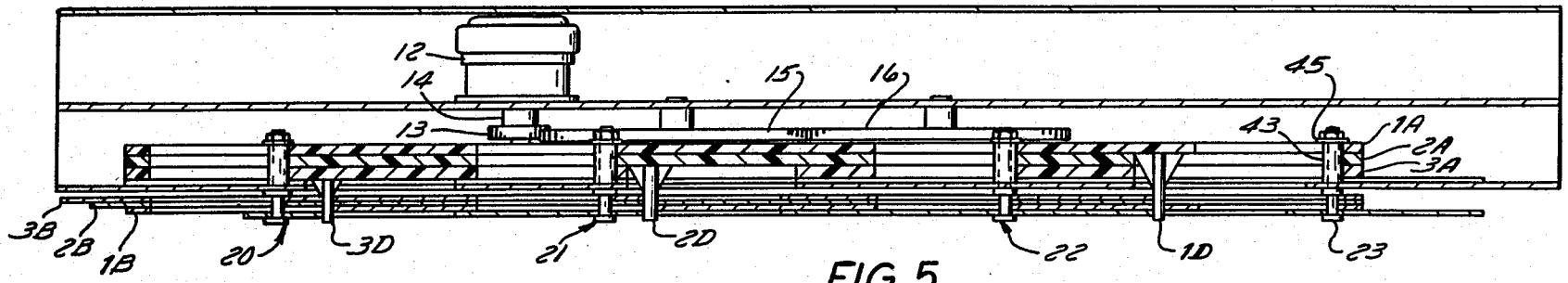
FIG. 5 is a transverse section taken on the line 5—5 in FIG. 4.

There are three slidable bars 1A, 2A and 3A mounted to the rear side of base plate 10 as is evident in FIGS. 1, 3 and 5. A wear strip or anti-friction strip 19 composed of a low friction material such as nylon is optionally interposed between metal base plate 10 and plastic slidable bar 3A. The bars are slidable on stud bolts 20–23 which are mounted to base plate 10. A typical stud such as the one marked 23 in FIG. 3 has one end portion 24 which is threaded and passes through a hole 25 in base plate 10 so that the threaded end of the stud projects rearwardly from plate 10. The studs have a flange 26 which abuts against the front of base plate 10. This provides for an unthreaded part 27 of each stud to extend frontwardly from plate 10. A typical stud has a head 28. The head can fit through a key hole portion 29 of a long slot such as the one marked 30 which is one slot among a total of five somewhat similar slots in the top strip 31 of the panel 3B from which the picture information bearing slats, such as the one marked 32 in FIG. 3, extend downwardly. All of the movable slat carrying panels 1B, 2B and 3B have slots corresponding to slot 30 for sliding on frontwardly extending portions 27 of the studs 20–23. Panel 4B is also mounted on studs 20–23 but it is stationary. As the slat panels 1B–3B are translated to the right in sequence under the influence of the actuator as can be perceived in FIGS. 3 and 5, the picture bearing slats of the panels overlap stationary front panel 4B in succession to present different pictures to the viewer. A front view of the stack of panels is depicted in FIG. 2. All of the panels are basically the same in that they comprise a laterally extending upper strip such as the one marked 33 of panel 4B in FIG. 2 and a plurality of thin slats 34 which are connected to a laterally extending lower strip 35.

As can be seen best in FIG. 3, the threaded parts of the panel supporting studs 20–23 have anti-friction sleeves 40–43 on them. Each of the movable actuator bars 1A–3A have slots such as the one marked 44 in bar 3A for hanging the sliding bars on the studs. These sleeves 40–43 constitute spacers having a length just slightly greater than the total thickness of the three actuator bars 1A–3A. FIG. 5 illustrates how a typical stud 23 has a washer and nut assembly 45 screwed tightly onto it. Because the sleeves 40–43 are slightly longer than the thickness of the three bars 1A–3A, the nut assemblies can be tightened on the bolts but the bars can slide freely relatively to each other.

Bars 1A–3A have integral downwardly extending integral cam follower lobes 1C, 2C and 3C, respectively. Bar 1A has a drive pin 1D extending frontwardly from it as can be seen best in FIGS. 3 and 5. Referring to FIG. 3, pin 1D would extend through aligned slots 46 and 44 in bars 2A and 3A, slot 47 in strip 19, slot 48 in base plate 10, slot 30 in panel 3B, 49 in panel 2B and then pin 1D extends into a hole 1E in panel 1B so pin 1D makes a driving connection with this panel. Thus, when bar 1A is driven to the right by cam pin 1 on gear 15 striking cam lobe 1C on its left side as shown in FIGS. 3 and 5, none of the other bars 2A or 2C will shift with bar 1A. Since pin 1D extends into panel 1B's hole 1E, panel 1B will shift to the right correspondingly with drive bar 1A. Hence, the tip of pin 1D in slidable bar 1A by simply extending into hole 1E in panel 1B can drive the panel 1B to the right in response to the cam follower lobe 1C being pushed by the shortest of the orbiting cam pins marked 1 on the gear 15. Bar 1A and panel 1B are the only components that will move together in response to bar 1A being driven by cam pin 1 of the gear.

Bar 2A also has a drive pin 2D extending from it. As indicated by the dashed line 51, pin 2D extends through slots in bar 3A, anti-friction strip 19, plate 10, panel 3B and extends into a hole 2E in panel 2B for driving this panel. Now, as the gear 15 continues to rotate clockwise as indicated in FIG. 3, the next longest axially extending pin 2 will strike the left side of lobe 2C on bar 2A, thereby causing this bar to shift to the right. Of course, drive pin 2D, by reason of it extending into hole 2E in panel 2B, will shift the panel 2B to the right by an amount equal to the amount by which bar 1A was shifted.

Bar 3A also has a drive pin 3D extending from it. As indicated by the dashed line 52, pin 3D extends freely through a slot in anti-friction strip 19 and a slot in plate 10 and findly enters a hole 3E in the innermost panel 3B. Thus, when orbiting cam pin 3 on gear 15 turns around and strikes the left edge of lobe 3C of slidable bar 3A, the bar will shift to the right by the same distance that the bars 1A and 2A have shifted. Now with all of the bars shifted, further rotation of the gear 15 will rotate return gear 16 sufficiently for its cam pin 18 to strike the right side of cam follower lobes 1C, 2C and 3C simultaneously so as to drive all bars back to their starting position wherein they are shown in FIGS. 3 and 5.

Figure 4:
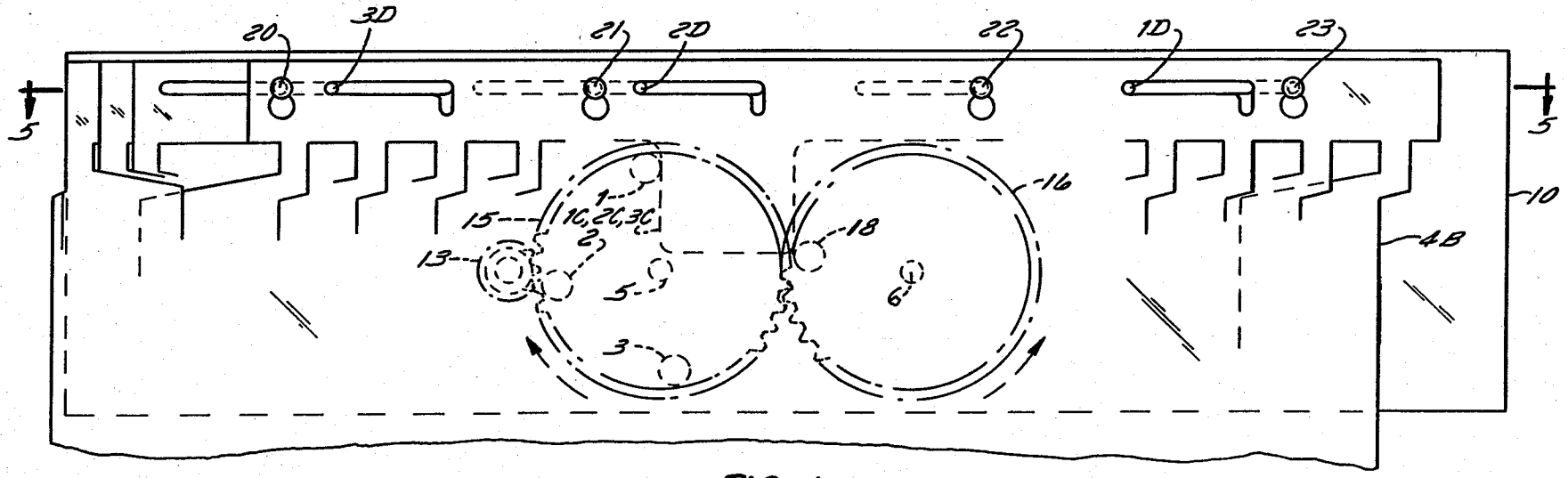
FIG. 4 is a front elevational view of the upper part of the sign assembly with the actuator mechanism behind it.

FIGS. 4 and 5 show all of the parts of the sign and actuator components positioned where they are at the start of a panel shifting cycle. In FIG. 4 return cam pin 18, orbiting counterclockwise on gear 16, has just completed restoring cam following lobes 1C, 2C and 3C and the bars 1A, 2A and 3A to which the lobes are attached to starting position so the panels 1B, 2B and 3C, respectively, are also at starting position. As cam pin 18 rotates clear of the lobes the shortest cam pin 1 has just reached the place where it will begin to push lobe 1C. Then with lobe 1 out of the way the next longest cam pin 2 reaches the shown position of cam 1 so cam pin 2 drives lobe 2C. Cam pin 3 next drives lobe 1C when this cam pi rotates to the shown position of cam pin 1.

Figure 6:
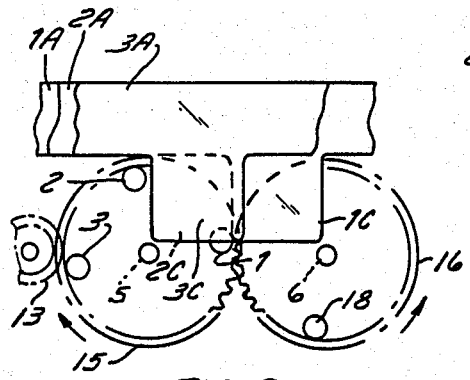
FIGS. 6–9 show the various stages the gears and slide bars go through to shift the panels and their interleaved slats so as to present a sequence of pictures to the viewer followed by returning all of the drive bars and, hence, the panels to their starting position for beginning another sequence of picture displays.
Figure 7:
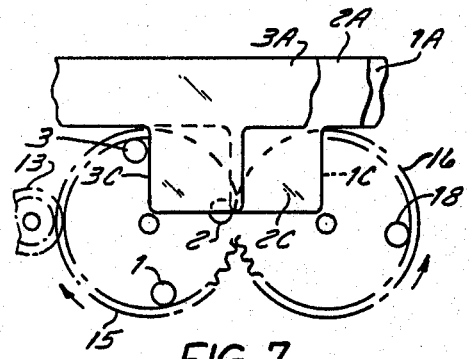

The sequence of operations is more easily perceived in FIGS. 6–9. In FIG. 6, drive pin 1 on clockwise rotating gear 15 has just finished its engagement with the left side of lobe 1C on bar 1A. In FIG. 6, drive pin 2 on gear 15 is just about to strike the left side of lobe 2C on bar 2A. When the lobe 2C on bar 2A is shifted to the right in coincidence with lobe 1C on bar IA, pin 3 on gear 15 will have rotated to the point where it will strike the left edge of lobe 3C as depicted in FIG. 7. Note that in FIG. 7 drive pin 18 on return gear 16 has advanced by 90° from its gear 6 position.

Figure 8:
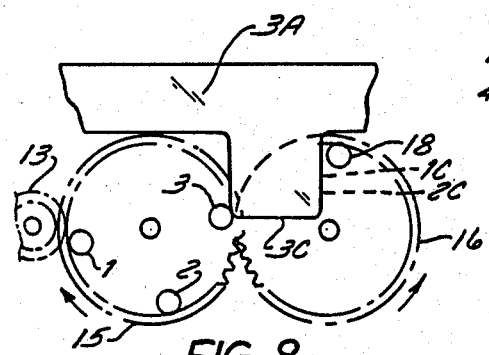
Figure 9:
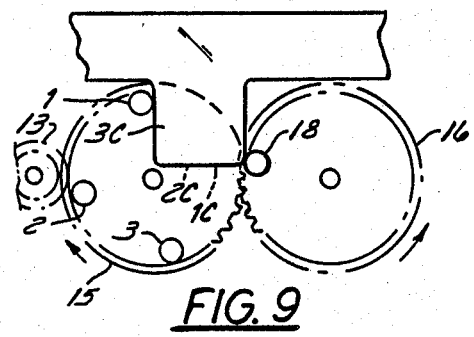

In FIG. 8, drive pin 3 on gear 15 has orbited to the point where it has completed pushing lobe 3C of the foremost sliding bar 3A to its right limit so that now in FIG. 8 the lobes 3A, 3B and 3C are congruent or coincident. When this stage is reached, the return drive pin 18 on the return gear 16 has advanced another 90° and is about ready to strike the right edge of all three lobes 3A, 3B and 3C of the sliding bars. In FIG. 9, pin 18 has rotated another 90° from its FIG. 8 position and has completed pushing all three of the lobes 1C, 2C and 3C and their affiliated slide bars to starting position.

As slide bars shift, of course, the panel slats shift correspondingly. As the first panel 1B shifts, its slats overlay the slats on the foremost stationary panel 4B. Then the succeeding panels 2B and 3B overlay 1B. Since panel 4B is stationary and exhibits one picture and the other panels 1B, 2B and 3B exhibit individual pictures, in this particular model, a total of four different pictures in sequence can be displayed.

In the described and illustrated preferred embodiment of the invention, the cams 1, 2 and 3 are mounted to a gear 15 so the cams revolve together in substantially the same plane about the rotational axis of the gear. Although most of the following parts are not shown, it is written in the boundaries of the inventive concept to have three ordinary cams with angularly displaced lobes mounted on a common shaft adjacent and aligned with the follower lobes such as lobes 1C, 2C and 3C which extend from the slide bars 1A, 2A and 3A. The cam shaft could be positioned for its axis to coincide with the rotational axis of gear 15 and the shaft could be an extension of gear shaft 5. These cams could be simple fingers extending radially from the shaft so they can strike the follower lobes and then clear them in succession.

It should be understood that in an actual application, the sign is enclosed in a windowed protective housing, not shown, and there are light sources in the housing for illuminating the pictures formed with the movable panels. Those skilled in the art will also perceive and appreciate that the drive mechanism can be coupled to the panels by way of their lower strips rather than their upper strips and that the drive mechanism can be in front of or to the rear of the stack of display panels.

I claim:

1. A sign including sequentially laterally slidable display panels comprised of strips having laterally extending slots and slats extending from said strips interleaved with slats of adjacent panels, a base member presenting opposite sides and having laterally extending slots, means supporting said panels for sliding on one side of said base member laterally relative to each other along the slots in the panel strips, actuator means including a plurality of interfacing bar members arranged on the other side of said base member, said bar members having drive pins projecting from them which pass through slots in said base member and engage, respectively, in driving relation with successive panels, means for supporting said bar members for sliding laterally in sequence relative to each other on the other side of the base member, first and second intermeshed gears and means for driving one of said gears rotationally in one direction so the other gear rotates in the opposite direction about axes substantially perpendicular to the lateral direction, cam pins of shortest, intermediate and longest lengths arranged in succession about the rotational axis of said first gear and projecting axially therefrom, rotation of said first gear causing the shortest cam pin to engage and shift the bar member most remote from said base laterally such that said drive pin of the bar member shifts the panel with which it is engaged to start a display cycle and continued rotation of said first gear causes the increasingly longer cam pins to shift the bar members successively nearer to said base member in sequence such that the drive pins on said bar members will shift sequentially the panels which the drive pins engage, a cam pin extending axially from said second gear, said gears being synchronized such that when all of said bar members are shifted in one direction laterally said cam pin on the second gear will be at a rotational position for starting to return all of said bars and, hence, said panels simultaneously to their unshifted positions to enable repetition of an operating cycle.

2. The sign according to claim 1 wherein said means for driving one of said gears rotationally comprises motor means including a shaft and a pinion on said shaft meshed with said one of said gears.

3. The sign according to claim 1 wherein said gears are of the same size.

4. The sign according to claim 1 including cam follower elements extending from said bar members, respectively, and lying in the same plane as the bar members from which said follower elements extend, said cam pins engaging said follower elements in succession to effect said lateral shifting of the bar members.

5. The sign according to claim 1 wherein said cam pin extending from said second gear for returning said slidable bars to their initial positions is axially coextensive with the longest of said cam pins on said first gear.

6. The sign according to claim 1 wherein said panel most remote from said base member is and remains stationary when the other panels are shifted.

7. The sign according to claim 1 wherein said means for supporting said panels and said bar members for sliding laterally relative to said base member comprises a plurality of studs having opposite ends at least one of which is threaded and a shoulder intermediate of said ends, said studs passing through holes arranged in a straight line along said base member and said shoulders abutting the panel side of said base member to provide for one part of said studs to extend away from one side of said base member and the threaded part of said studs to extend away from the other side of said base member next to which said bar members are arranged, said one parts of said studs extending through said slots in the panels to support them for sliding and said threaded parts of said studs extending through said slots in said bar members, spacer sleeves slipped over said studs where they extend through the slots in said bar members, said sleeves being slightly longer than the total thickness of said bar members, and washers on said threaded ends of said studs abutting the ends of said sleeve and threaded nuts retaining said washers and sleeves.

* * * * *